US008926274B2

(12) United States Patent
Kuzi et al.

(10) Patent No.: US 8,926,274 B2
(45) Date of Patent: Jan. 6, 2015

(54) BEARING HOUSING BODY GROUP OF AN EXHAUST-GAS TURBOCHARGER

(75) Inventors: Hildwin Kuzi, Eppelheim (DE); Thomas Fitting, Wonsheim (DE)

(73) Assignee: BorgWarner Inc., Auburn Hills, MI (US)

( * ) Notice: Subject to any disclaimer, the term of this patent is extended or adjusted under 35 U.S.C. 154(b) by 548 days.

(21) Appl. No.: 12/999,370

(22) PCT Filed: Jun. 26, 2009

(86) PCT No.: PCT/US2009/048763

§ 371 (c)(1),
(2), (4) Date: Dec. 16, 2010

(87) PCT Pub. No.: WO2010/002717

PCT Pub. Date: Jan. 7, 2010

(65) Prior Publication Data

US 2011/0103948 A1 May 5, 2011

(30) Foreign Application Priority Data

Jul. 2, 2008 (DE) ..... 10 2008 031 349

(51) Int. Cl.
*F01D 25/24* (2006.01)
*F01D 25/16* (2006.01)
*F02B 37/00* (2006.01)

(52) U.S. Cl.
CPC ..... *F01D 25/162* (2013.01); *F02B 37/00* (2013.01); *F05D 2260/33* (2013.01); *F05D 2220/40* (2013.01)
USPC ..... 415/203

(58) Field of Classification Search
USPC ..... 415/203, 190, 118, 121.2, 201; 417/454, 407, 360
See application file for complete search history.

(56) References Cited

U.S. PATENT DOCUMENTS

| | | | | |
|---|---|---|---|---|
| 3,961,867 | A * | 6/1976 | Woollenweber | 417/407 |
| 3,993,370 | A * | 11/1976 | Woollenweber | 384/287 |
| 4,176,815 | A * | 12/1979 | Davidson et al. | 248/589 |
| 4,474,484 | A * | 10/1984 | MacInnes et al. | 384/215 |
| 4,704,075 | A * | 11/1987 | Johnston et al. | 417/407 |
| 4,808,091 | A * | 2/1989 | Ruetz | 417/407 |
| 5,044,883 | A * | 9/1991 | Neueder | 415/214.1 |
| 5,118,254 | A * | 6/1992 | Ellingson et al. | 415/213.1 |
| 5,232,341 | A * | 8/1993 | Shier et al. | 415/201 |
| 5,338,154 | A * | 8/1994 | Meade et al. | 415/173.7 |
| 5,549,449 | A * | 8/1996 | McInerney et al. | 415/177 |
| 5,967,762 | A * | 10/1999 | Keller et al. | 417/407 |
| 6,247,440 | B1 * | 6/2001 | Gron, Jr. | 123/196 R |
| 2005/0042105 | A1 * | 2/2005 | Nishiyama et al. | 416/183 |
| 2007/0201977 | A1 * | 8/2007 | Clarence et al. | 415/214.1 |
| 2007/0216161 | A1 * | 9/2007 | Regener et al. | 285/377 |
| 2009/0060737 | A1 * | 3/2009 | Frankenstein et al. | 415/229 |
| 2009/0142186 | A1 * | 6/2009 | Parker | 415/159 |

* cited by examiner

*Primary Examiner* — Nathaniel Wiehe
*Assistant Examiner* — Eldon Brockman
(74) *Attorney, Agent, or Firm* — William G. Anderson; Stephan A. Pendorf; Patent Central LLC

(57) ABSTRACT

The invention relates to a bearing housing body group (1) of an exhaust-gas turbocharger, having a housing (2) for a bearing arrangement of a rotor shaft (3); having a turbine wheel (4) on one end (5) of the rotor shaft (3); having a compressor wheel (6) on the opposite end (7) of the rotor shaft (3); and having a compressor-wheel-side housing cover (8) which can be fixed by means of a fastening device (9) in a compressor-wheel-side housing opening (10), wherein the fastening device (9) is designed as a bayonet connection.

9 Claims, 3 Drawing Sheets

BEARING HOUSING BODY GROUP OF AN EXHAUST-GAS TURBOCHARGER

The invention relates to a bearing housing body group of an exhaust-gas turbocharger, as per the preamble of Claim 1.

Within the context of downsizing programmes for internal combustion engines, ever smaller and more compact exhaust-gas turbochargers are the preferred embodiments. However, the oil quantity required for the function of mounting the rotor cannot be reduced to the same extent as the external dimensions. Relatively small exhaust-gas turbochargers therefore tend in particular to oil up at the compressor side at certain operating points, since the volume available in the bearing housing for discharging the oil is relatively small.

It is therefore an object of the present invention to create a bearing housing body group of an exhaust-gas turbocharger as per the preamble of Claim 1 which permits a compact design of the exhaust-gas turbocharger with a simultaneous improvement of the compressor-side oil sealing.

Said object is achieved by means of the features of Claim 1.

In contrast to known bearing housing body groups, in which the bearing housing cover is fastened by means of conventional connecting techniques such as screws or circlips, the design of the fastening device according to the invention as a bayonet connection has the advantage that the space between the axial bearing and the housing cover of the bearing housing body group can be designed to be so large that oil can flow out unhindered, and the oil pressure can be depleted in an unhindered fashion to the same value as that in the crankcase of the engine.

The subclaims relate to advantageous refinements of the invention.

The bayonet connection of the body group according to the invention may, in a particularly preferred embodiment, have a web arrangement on the housing cover and an associated groove arrangement in the housing opening, with an arrangement of three webs being preferable, which three webs may be arranged uniformly on the periphery of a web ring of the housing cover, with a spacing of 120° conventionally being provided.

The groove arrangement of the housing opening may, for this purpose, have three part-ring grooves which are separated from one another by webs and which are provided in each case with an insertion recess into which the webs of the web arrangement can be inserted and come to rest, and latch, in a recess at the end of the part-ring grooves.

For fixing, it is necessary merely for the housing cover, after the positioning of the webs with respect to the insertion recesses, to be moved axially by a defined distance, such that the webs can be rotated into the part-ring grooves in the circumferential direction by a defined angle in the rotational direction of the rotor. Having arrived in said position, the axial pushing force can be removed and the webs come to rest in an axial recess at the end of the part-ring grooves, such that latching takes place and a backward rotation is reliably prevented.

In one particularly preferred embodiment, the housing cover is provided with a holding groove for an O-ring. Here, the holding groove may be open at one end side or closed at both end sides.

In the case of the groove of the housing cover being open at one side, the O-ring is axially compressed during the fixing of said housing cover in the bearing housing, which axial compression of the O-ring firstly provides an axial force component for increasing the axial clamping force and secondly ensures the sealing action, whereas a groove for the O-ring which is closed at both sides provides merely a radial compression for the sealing function.

Furthermore, in a further particularly preferred embodiment, it is possible to arrange a spring plate in the bearing housing between the housing cover and the axial bearing, which spring plate fixes the axial bearing axially.

The spring plate may preferably be designed as a plate spring.

Further details, advantages and features of the present invention can be gathered from the following description of exemplary embodiments on the basis of the drawing, in which.

Figure 2:
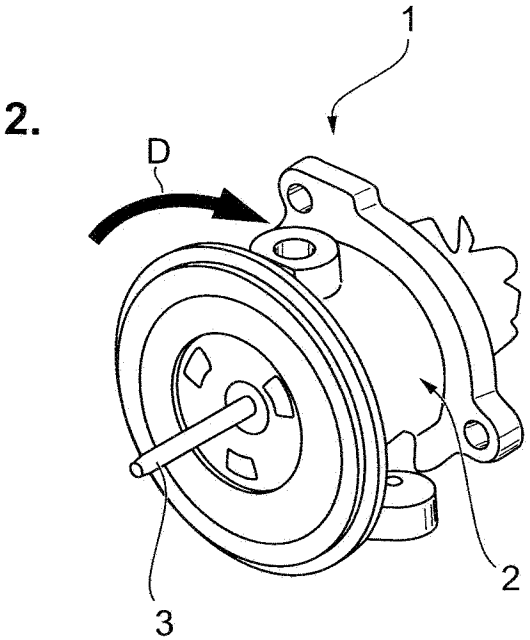
FIG. 2 shows an illustration corresponding to FIG. 1, with the housing cover mounted.
Figure 1:
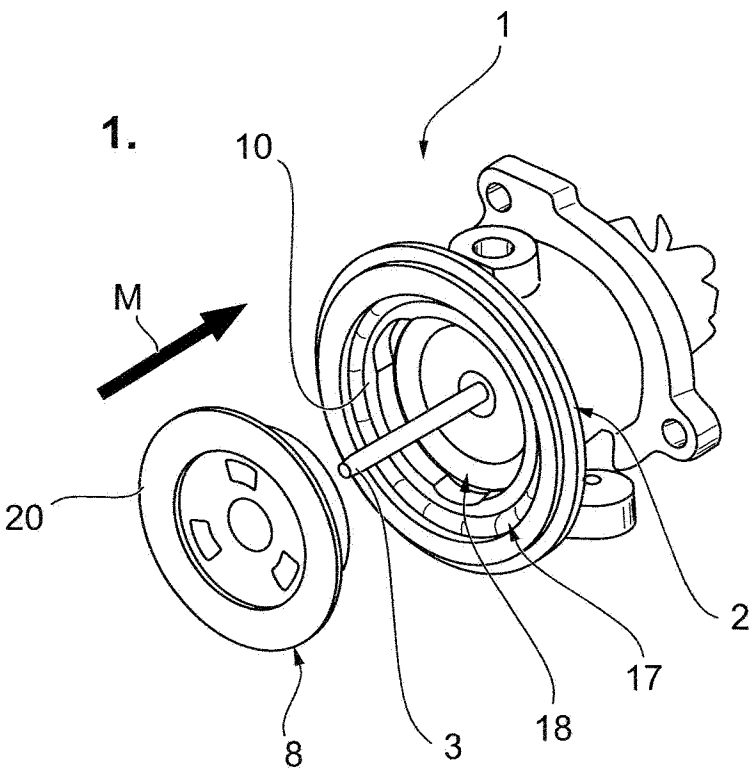
FIG. 1 shows a perspective illustration of a first embodiment of a bearing housing body group with the housing cover not yet mounted.

FIGS. 1 and 2 illustrate a bearing housing body group 1 of an exhaust-gas turbocharger, wherein FIG. 1 shows a state before a housing cover 8 is mounted and FIG. 2 shows the state after said housing cover 8 is mounted.

The body group 1 has a housing 2 for a bearing arrangement (not illustrated in any more detail in the figures) of a rotor shaft 3.

The body group 1 also comprises a turbine wheel 4 on one end 5 of the rotor shaft 3, while a compressor wheel 6 is arranged on the opposite end 7 of the rotor shaft 3.

The housing cover 8 can be fixed at the compressor side in a compressor-wheel-side housing opening 10 by means of a fastening device 9.

According to the invention, the fastening device 9 is designed as a bayonet connection which has a web arrangement 11 on the housing cover 8 and a groove arrangement 12 in the housing opening 10 of the housing 2.

Figure 4:
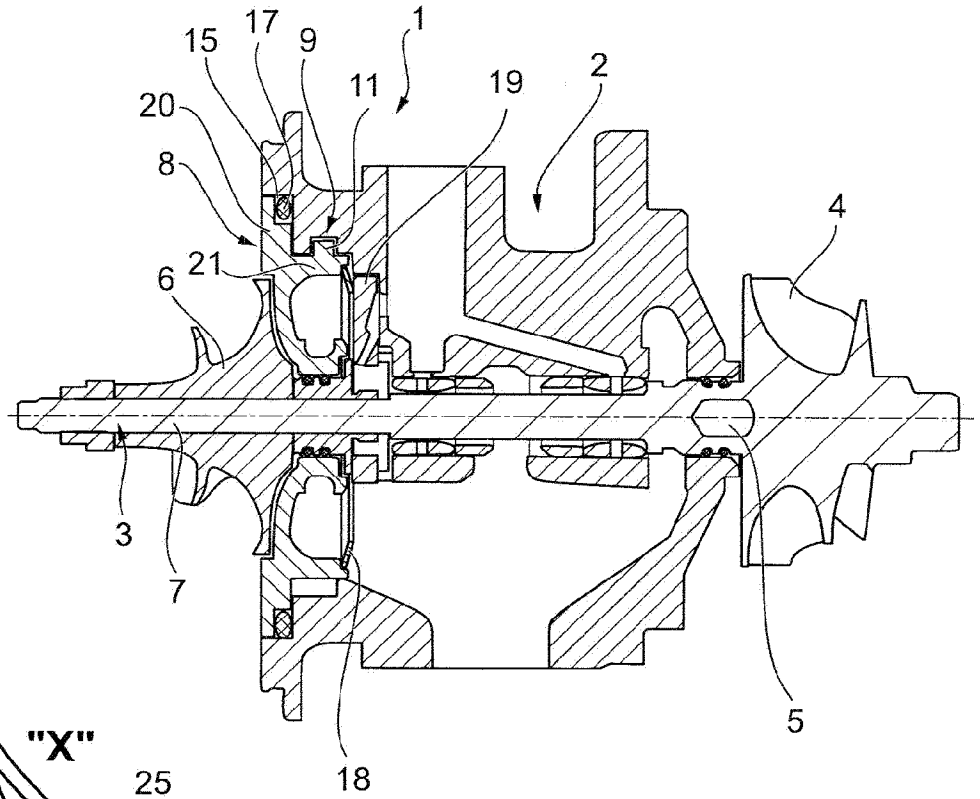
FIG. 4 shows a longitudinal section through the bearing housing body group according to FIG. 3.

Of the web arrangement, FIG. 4 shows a web 11, though three such webs are preferably provided, which webs are arranged uniformly on the periphery of a web ring 21 of the housing cover 8. Here, the web ring 21 is arranged substantially perpendicular to a cover plate 20 of the housing cover 8, and in the mounted state of the housing cover 8, points into the bearing housing, as can be seen in particular from the illustration of FIGS. 4 and 5.

Figure 3A:
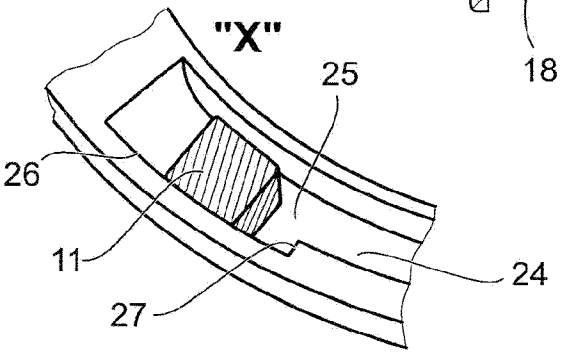
FIG. 3A shows an illustration of the detail "X" from FIG. 3 on an enlarged scale.
Figure 3:
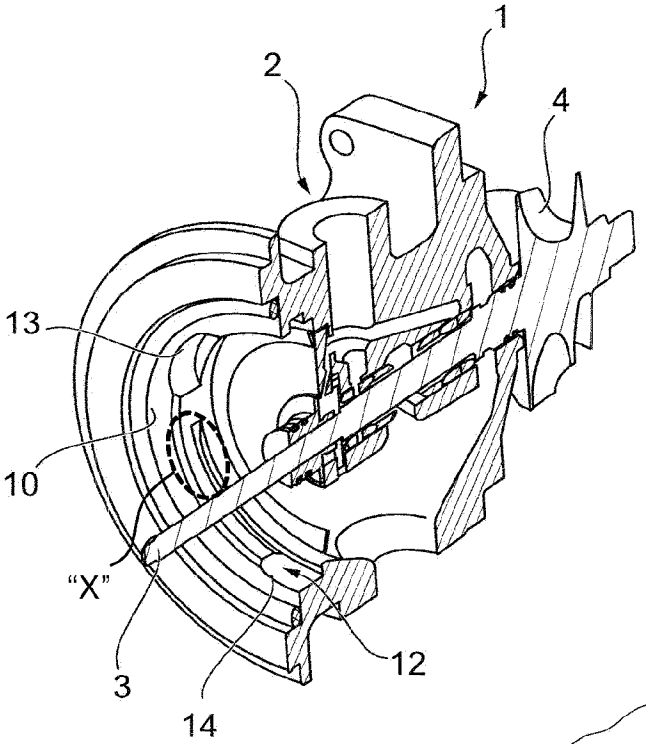
FIG. 3 shows a perspective, partially sectioned illustration of the bearing housing body group as per FIG. 1.

The annular groove arrangement 12 has a number of insertion recesses corresponding to the number of webs 11, that is to say in the example, three such insertion recesses, of which the insertion recesses 13 and 14 can be seen in the illustration of FIG. 3. In each case one recess 25 with the axial contact surface 26 for the webs 11 is arranged at the end of the part-ring grooves 24. Here, a backward rotation of the webs without the application of an axial force is prevented by the latching edge 27 of the recess 25 (see FIG. 3A).

The housing cover 8 may also have a holding groove 15 (see FIG. 4) or a holding groove 16 (see FIG. 5) which serves to hold an O-ring 17.

The embodiment of the holding groove 15 which can be seen in FIG. 4 is open at one end side, as can be seen in detail from the illustration of FIG. 4.

Figure 5:
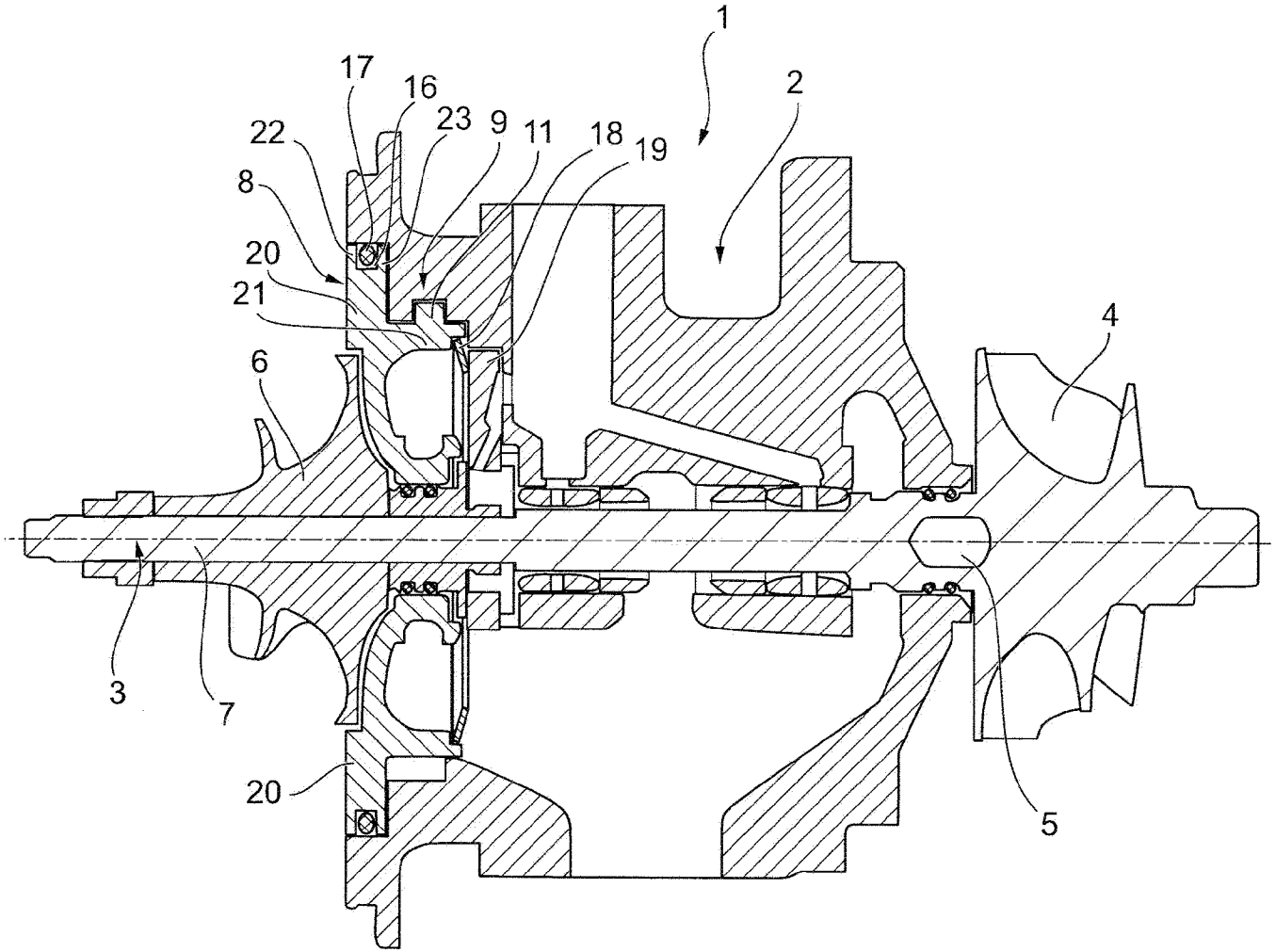
FIG. 5 shows an illustration, corresponding to FIG. 4, of a second embodiment of the bearing housing body group.

The embodiment according to FIG. 5, in contrast, has a holding groove 16 which is closed at both end sides by groove webs 22 and 23, so as to form a U-shaped cross-sectional profile of the groove 17 which, in the mounted state of the housing cover 18, has the result that said housing cover 18 is compressed only radially, and therefore performs its sealing function.

However, the embodiment of FIG. 5 otherwise corresponds to that of FIG. 4, such that with regard to all corresponding features and functions, reference can be made to the description of said FIG. 4.

It can correspondingly be seen from the illustration of FIGS. 4 and 5 that both embodiments are also provided with a spring plate 18 which, in the mounted state of the housing cover 8, is arranged between said housing cover 8 and an axial bearing 19 in order to fix the latter. Said spring plate, which may have a conical cross section, may preferably be designed as a spring plate.

In addition to the written disclosure of the invention, reference is hereby explicitly made to the diagrammatic illustration of said invention in FIGS. 1 to 5.

LIST OF REFERENCE SYMBOLS

1 Bearing housing body group
2 Housing
3 Rotor shaft
4 Turbine wheel
5 First end of the rotor shaft 3
6 Compressor wheel
7 Second, opposite end of the rotor shaft 3
8 Housing cover
9 Fastening device
10 Housing opening
11 Web arrangement/webs
12 Groove arrangement
13, 14 Insertion recesses
15, 16 Holding grooves
17 O-ring
18 Spring plate
19 Axial bearing
20 Cover plate of the housing cover 8
21 Web ring
22, 23 Groove webs
24 Part-ring grooves
25 Recesses on part-ring groove end
26 Contact surface for web
27 Latching edge of the recess 24
M Mounting direction for the housing cover 8
D Rotational direction of the housing cover 8 for fixing the latter in the housing 2

The invention claimed is:

1. A bearing housing body group (1) of an exhaust-gas turbocharger comprising:
a housing (2) for a bearing arrangement of a rotor shaft (3);
a turbine wheel (4) on one end (5) of the rotor shaft (3);
a compressor wheel (6) on an opposite end (7) of the rotor shaft (3); and
a compressor-wheel-side housing cover (8) fixed by means of a fastening device (9) in a compressor-wheel-side housing opening (10), wherein the compressor-wheel-side housing cover (8) is located substantially entirely within the housing (2), wherein the compressor-wheel-side housing cover (8) is substantially flush with an axially outermost face of the housing (2), and wherein the fastening device (9) is a bayonet connection.

2. The bearing housing body group according to claim 1, wherein the bayonet connection (9) has a web arrangement (11) on the housing cover (8) and a groove arrangement (12) in the housing opening (10).

3. The bearing housing body group according to claim 2, wherein the web arrangement (11) has three webs which are arranged uniformly on the periphery of a web ring (21) of the housing cover (8) and which can be inserted into an annular groove arrangement (12) of the housing opening (10).

4. The bearing housing body group according to claim 3, wherein the annular groove arrangement (12) includes three insertion recesses (13, 14).

5. The bearing housing body group according to claim 1, wherein the housing cover (8) has a holding groove (15, 16) for holding an O-ring (17).

6. The bearing housing body group according to claim 5, wherein the holding groove (15) is formed so as to be open at one of its two end sides.

7. The bearing housing body group according to claim 5, wherein the holding groove (16) is formed so as to be closed at both end sides.

8. A bearing housing body group (1) of an exhaust-gas turbocharger comprising:
a housing (2) for a bearing arrangement of a rotor shaft (3);
a turbine wheel (4) on one end (5) of the rotor shaft (3);
a compressor wheel (6) on an opposite end (7) of the rotor shaft (3); and
a compressor-wheel-side housing cover (8) fixed by means of a fastening device (9) in a compressor-wheel-side housing opening (10), wherein the fastening device (9) is a bayonet connection, wherein the bayonet connection (9) has a web arrangement (11) on the housing cover (8) and an annular groove arrangement (12) in the housing opening (10),
wherein the annular groove arrangement (12) includes part ring grooves (24), wherein an end of each part ring groove (24) includes a recess (25) having a contact surface (26) and a latching edge (27).

9. A bearing housing body group (1) of an exhaust-gas turbocharger comprising:
a housing (2) for a bearing arrangement of a rotor shaft (3);
a turbine wheel (4) on one end (5) of the rotor shaft (3);
a compressor wheel (6) on an opposite end (7) of the rotor shaft (3); and
a compressor-wheel-side housing cover (8) fixed by means of a fastening device (9) in a compressor-wheel-side housing opening (10), wherein the fastening device (9) is a bayonet connection,
wherein a spring plate (18) for fixing an axial bearing (19) of the rotor shaft (3) is arranged between and directly operatively engages the axial bearing (19) and the housing cover (8).

* * * * *